US008373634B2

(12) United States Patent
Jeon

(10) Patent No.: US 8,373,634 B2
(45) Date of Patent: Feb. 12, 2013

(54) SOURCE DRIVER FOR DISPLAY DEVICES

(75) Inventor: Yong Weon Jeon, Seongnam-si (KR)

(73) Assignee: TLI Inc., Seongnam-Si (KR)

( * ) Notice: Subject to any disclaimer, the term of this patent is extended or adjusted under 35 U.S.C. 154(b) by 946 days.

(21) Appl. No.: 12/464,160

(22) Filed: May 12, 2009

(65) Prior Publication Data

US 2010/0123690 A1 May 20, 2010

(30) Foreign Application Priority Data

Nov. 14, 2008 (KR) ..... 10-2008-0113199

(51) Int. Cl.
*G09G 3/36* (2006.01)

(52) U.S. Cl. ..... 345/98; 345/87; 345/100; 345/204

(58) Field of Classification Search ..... 345/76–100, 345/204
See application file for complete search history.

(56) References Cited

U.S. PATENT DOCUMENTS

2003/0132907 A1* 7/2003 Lee et al. ..... 345/98
2004/0104873 A1* 6/2004 Kang et al. ..... 345/87
2005/0128170 A1* 6/2005 Kang et al. ..... 345/87
2005/0264548 A1* 12/2005 Okamura et al. ..... 345/204
2008/0180369 A1* 7/2008 Chiu et al. ..... 345/87
2009/0079767 A1* 3/2009 Morita ..... 345/690

FOREIGN PATENT DOCUMENTS

KR 10-2003-0058520 A 7/2003
KR 10-2004-0075628 A 8/2004
KR 10-2006-0070709 A 6/2006
KR 10-2008-0012070 A 2/2008
KR 10-2008-0023491 A 3/2008

* cited by examiner

*Primary Examiner* — Viet Pham
(74) *Attorney, Agent, or Firm* — Kile Park Goekjian Reed & McManus PLLC

(57) ABSTRACT

A source driver for display devices includes line pair driving blocks. Each of the line pair driving blocks includes a de-multiplexing portion for de-multiplexing first and second digital data to generate first and second de-multiplexing data, a decoding portion for decoding the first and second de-multiplexing data to generate first and second analog data, and a multiplexing portion for multiplexing the first and second analog data to generate first and second gradation voltages. In the source driver, the de-multiplexing portion is controlled by signals having information of loading timing for the digital data and information of polarity for the gradation voltages.

8 Claims, 10 Drawing Sheets

( Prior Art )

( Prior Art )

( Prior Art )

SOURCE DRIVER FOR DISPLAY DEVICES

BACKGROUND OF THE INVENTION

1. Field of the Invention

The present invention relates to a source driver for display devices and, more particularly, to a source driver for driving data lines for a display panel.

2. Description of the Related Art

Display devices such as Liquid Crystal Display (LCD) have been used in various areas of industries. Generally, as shown in FIG. 1, a display device comprises a display panel DISPAN, a gate driver GDRV, and a source driver SDRV. The display panel DISPAN displays images according to data provided thereto. The gate driver GDRV selects and drives gate lines GL in the display panel DISPAN. The source driver SDRV provides gradation voltages to data lines DL in the display panel DISPAN for displaying images. At this time, the gradation voltages are corresponding to digital data DDAT which is provided from a controller UCON through a data bus DA_BUS. The controller UCON generates control signals to control the gate driver GDRV and the source driver SDRV.

As shown in FIG. 2, pixels are arranged in the display panel DISPAN at regions where the data lines DLs and the gate lines GLs are intersecting each other. The pixels are driven with the gradation voltages corresponding to the data provided through the data lines DL. The gradation voltages are provided to the display panel DISPAN from the source driver SDRV.

In general, the pixels PIXs in the display panel DISPAN are driven with a data inversion driving method. According to the data inversion driving method, as shown in FIG. 3, the pixels PIXs in the display panel DISPAN are each alternatively driven with a positive polarity of a gradation voltage and a negative polarity of the gradation voltage. For example, a pixel PIX of FIG. 3 is driven with the positive polarity of a gradation voltage in a first field, and then the pixel PIX is driven with the negative polarity of the gradation voltage in a second field.

The source driver SDRV, which is driven with a data inversion driving method, includes a positive decoder and a negative decoder for decoding display data. At this time, a layout region of the positive decoder is separated from that of the negative decoder. The positive decoder generates the positive polarity of the gradation voltage, and includes PMOS transistors. The negative decoder generates the negative polarity of the gradation voltage, and includes NMOS transistors.

For effective layout of the positive decoder and the negative decoder, two data lines DLs are shared by the positive decoder and negative decoder. In this case, it is required that the display data of each data line DL is alternatively coupled to the positive decoder and negative decoder. For such a construction, many transistors are required for data inversion driving method.

SUMMARY OF THE INVENTION

A source driver according to an exemplary embodiment of the present invention may include line pair driving blocks that are each operated to drive a first data line and a second data line being adjacent to each other in a display panel; and a control block for receiving a loading signal and a polarity signal to generate a first and second loading polarity control signals and a de-multiplexing latch signal, wherein the loading signal has information of loading timing for first and second digital data, and the polarity signal has information of polarity for first and second gradation voltages. Each of the line pair driving blocks includes a data receiving portion for receiving the first and second digital data in the first and second data lines; a de-multiplexing portion for de-multiplexing the first and second digital data to generate first and second de-multiplexing data, wherein the first and second de-multiplexing data are selectively corresponding to the first and second digital data according to the first and second loading polarity control signals, and the first and second de-multiplexing data are latched in accordance with the de-multiplexing latch signal; a decoding portion for decoding the first and second de-multiplexing data to generate first and second analog data, wherein the first and second analog data have first and second polarities, respectively; and a multiplexing portion for multiplexing the first and second analog data to generate the first and second gradation voltages, wherein the first and second gradation voltages are corresponding to the first and second digital data, respectively.

The data receiving portion may include a first sampling latch for sampling and latching the first digital data in the first data line; and a second sampling latch for sampling and latching the second digital data in the second data line.

The de-multiplexing portion comprises a first de-multiplexer for de-multiplexing the first digital data to generate one of first and second pre-data according the first and second loading polarity control signals; a second de-multiplexer for de-multiplexing the second digital data to generate the other of the first and second pre-data according the first and second loading polarity control signals; a first buffer latch for latching the first pre-data to generate the first de-multiplexing data; and a second buffer latch for latching the second pre-data to generate the second de-multiplexing data.

The decoding portion may include a positive decoder for decoding the first de-multiplexing data to generate the first analog data; and a negative decoder for decoding the second de-multiplexing data to generate the second analog data.

The multiplexing portion may include a first multiplexer for multiplexing the first and second analog data to generate an output corresponding to the first digital data; a second multiplexer for multiplexing the first and second analog data to generate an output corresponding to the second digital data; a first amplifier for amplifying an output of the first multiplexer to generate the first degradation voltage; and a second amplifier for amplifying an output of the second multiplexer to generate the second degradation voltage.

The control block may include a first logic for logically operating the loading signal and an inverted signal of the polarity signal; a second logic for logically operating the loading signal and the polarity signal; a third logic for logically operating an inverted signal of an output of the first logic and an inverted signal of an output of the second logic to generate the de-multiplexing latch signal; a first buffer for buffering the output of the first logic to generate the first loading polarity control signal; and a second buffer for buffering the output of the second logic to generate the second loading polarity control signal.

BRIEF DESCRIPTION OF THE DRAWINGS

The above and other features and advantages of the present invention will be more clearly understood from the following detailed description taken in conjunction with the accompanying drawings, in which.

DETAILED DESCRIPTION OF THE INVENTION

Figure 1:
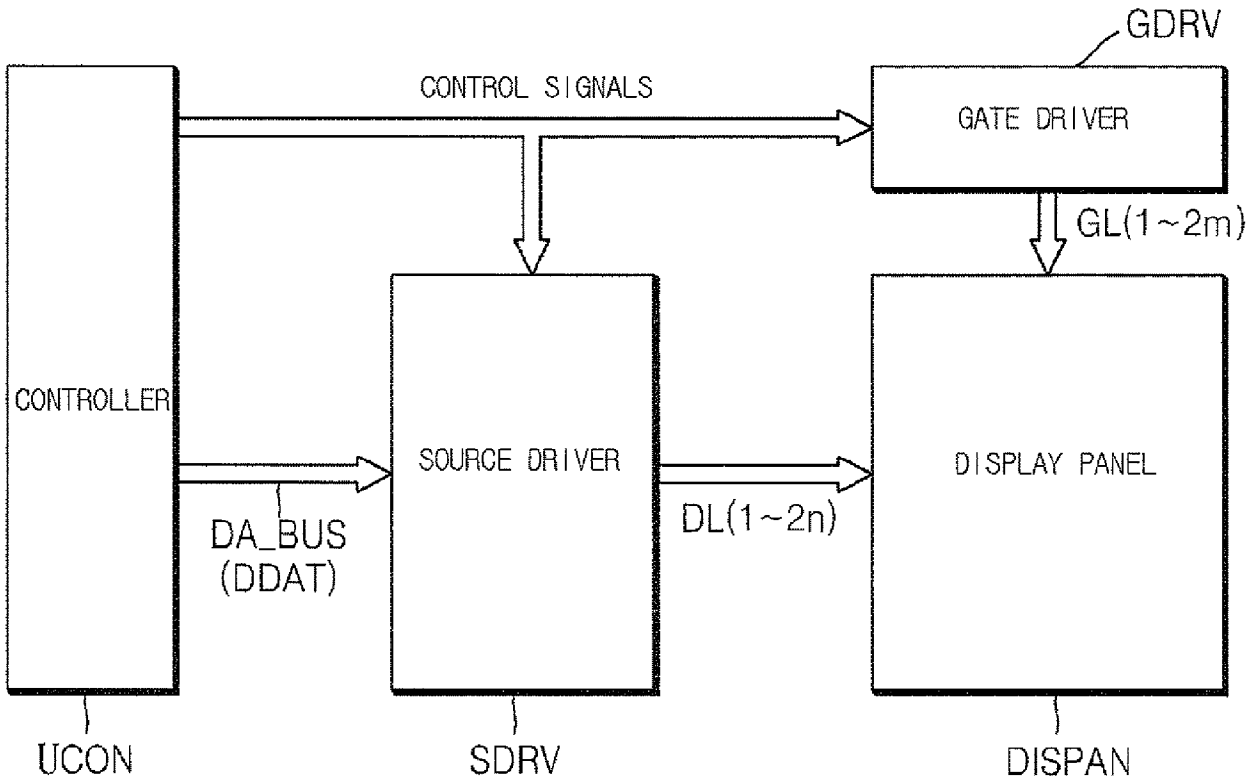
FIG. 1 is a block diagram showing a general display device.
Figure 2:
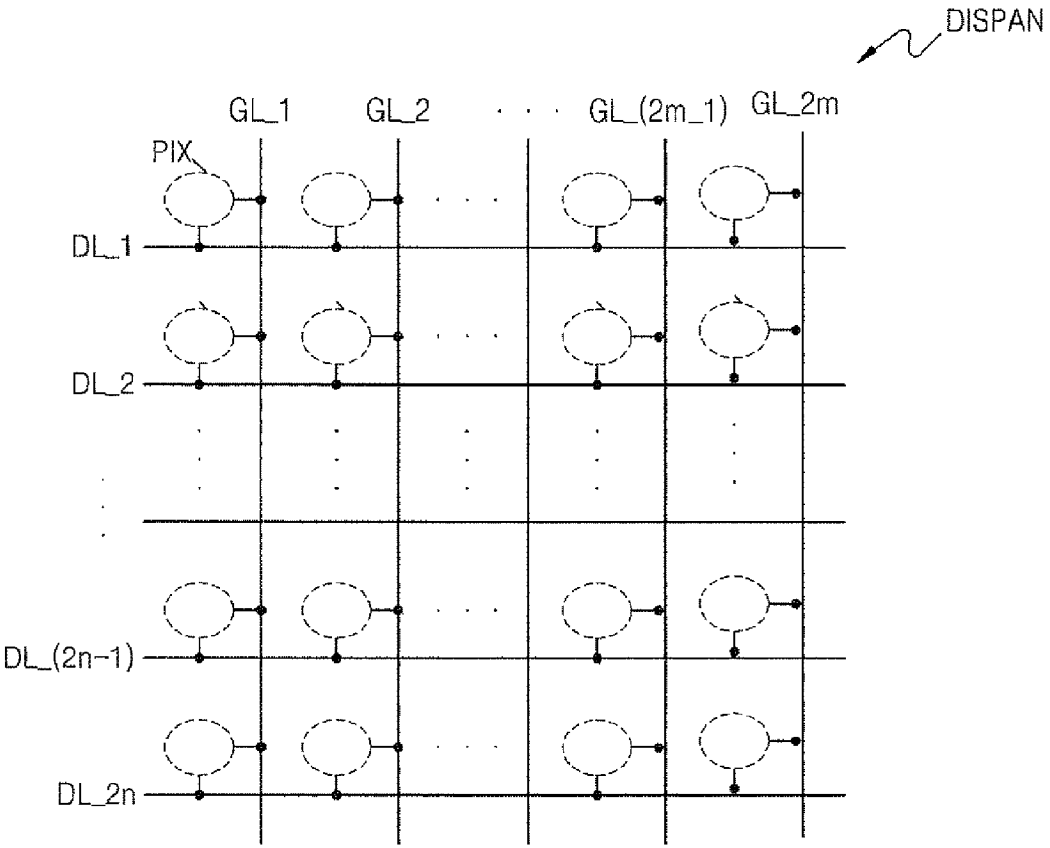
FIG. 2 is a drawing showing the display panel of FIG. 1.
Figure 3:
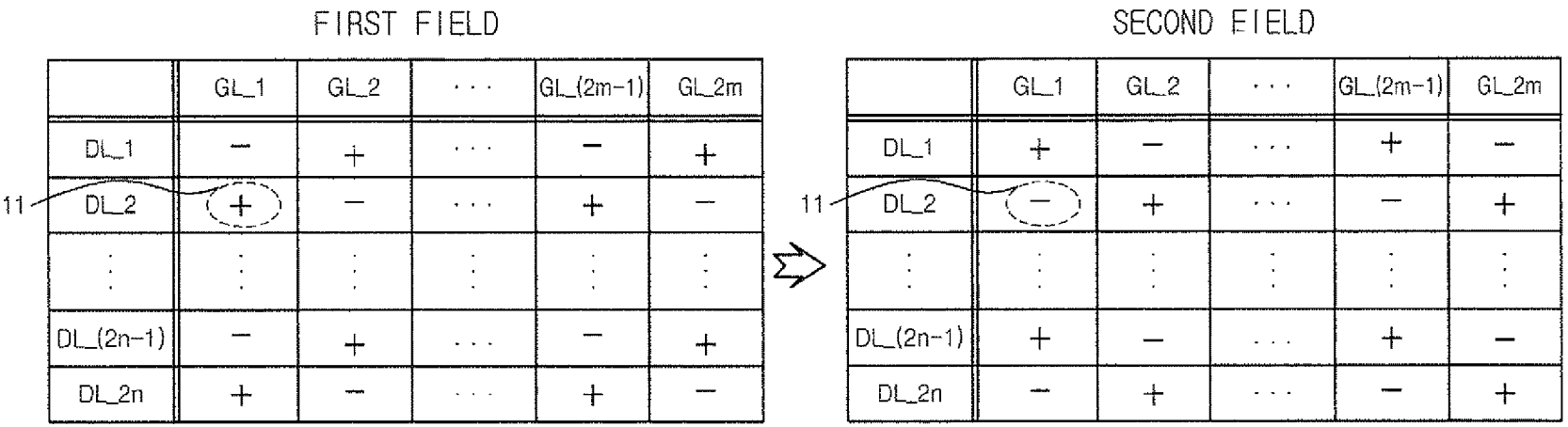
FIG. 3 is a drawing for explaining a data inversion driving method.

An exemplary embodiment of a source driver for reducing the layout area according to the present invention is described in detail with reference to the accompanying drawings below. For descriptions made with reference to the accompanying drawings, the same reference numerals are used throughout the different drawings to designate the same or similar components, and thus repeated description thereof is omitted. Furthermore, in the present specification, ordinal numbers (for example, "first" and "second") used to describe the present invention, are used only to distinguish the same or similar components from each other, and do not limit their order or number of the embodiments.

Figure 4:
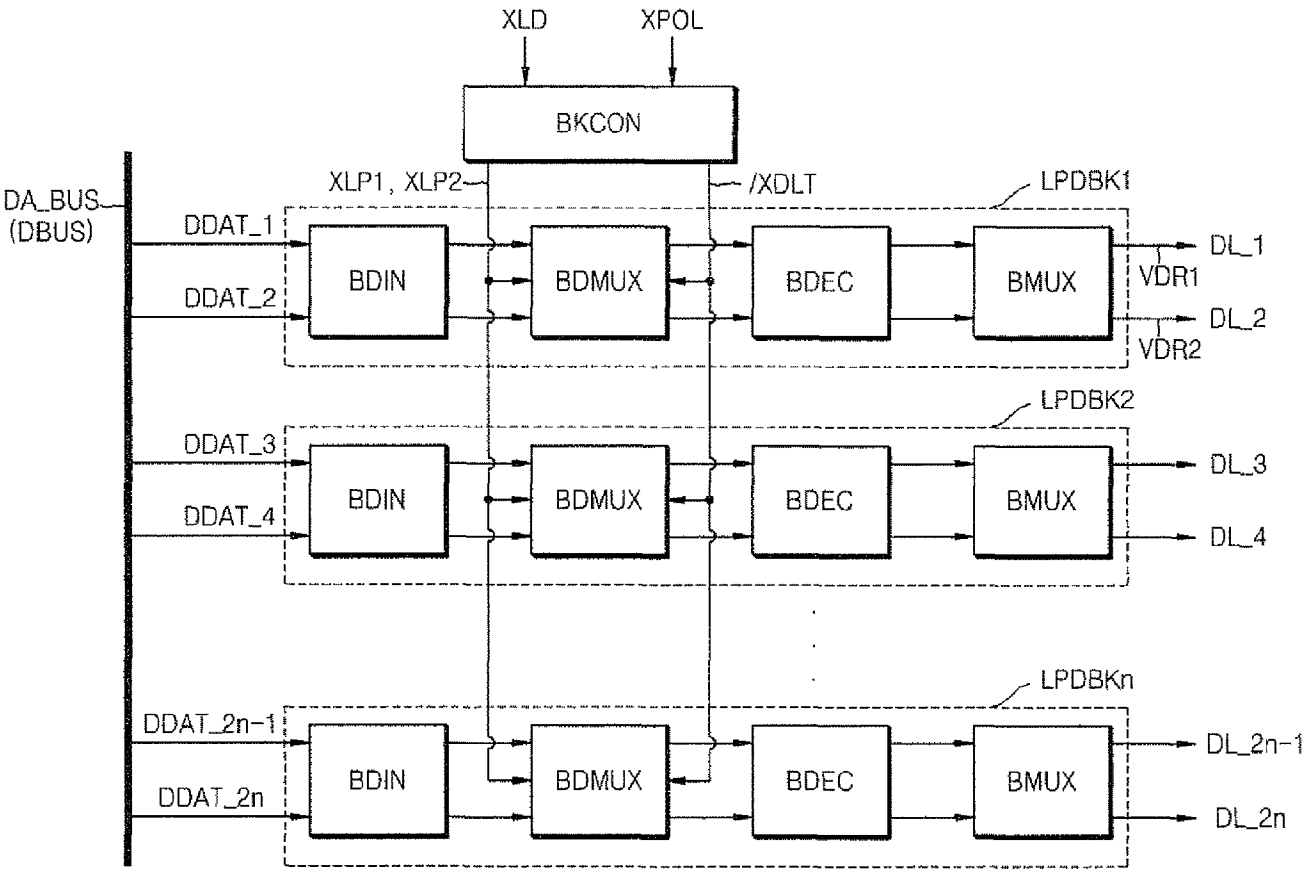
FIG. 4 is a block diagram showing a source driver according to an exemplary embodiment of the present invention.

FIG. 4 is a block diagram showing a source driver according to an exemplary embodiment of the present invention. Referring to FIG. 4, the source driver of the present invention drives a display panel DISPAN, and includes a plurality of line pair driving blocks LPDBK1~LPDBKn. In this embodiment, each of the line pair driving blocks LPDBK1~LPDBKn is operated to drive a corresponding data line pair. A data line pair comprises first and second data lines adjacent to each other in the display panel DISPAN.

For example, the line pair driving block LPDBK1 receives digital data DDAT_1 and digital data DDAT_2, and then drives the data line pair including data line DL_1 and data line DL_2. The line pair driving block LPDBK2 receives digital data DDAT_3 and digital data DDAT_4, and then drives the data line pair including data line DL_3 and data line DL_4. In a like manner, the line pair driving block LPDBKn receives digital data DDAT_2*n*-1 and digital data DDAT_2*n*, and then drives the data line pair including data line DL_2*n*-1 and data line DL_2*n*.

The digital data lines DDAT_1~DDAT_2*n* are included in bus data DBUS transferred through a data bus DA_BUS. The digital data lines are each latched in a corresponding one of the line pair driving blocks LPDBK1~LPDBKn with relevant timing.

The line pair driving blocks LPDBK1~LPDBKn can be disposed and arranged in similar forms. In this specification, for convenience of explanation, the line pair driving block LPDBK1 is described as a representative example.

Figure 5:
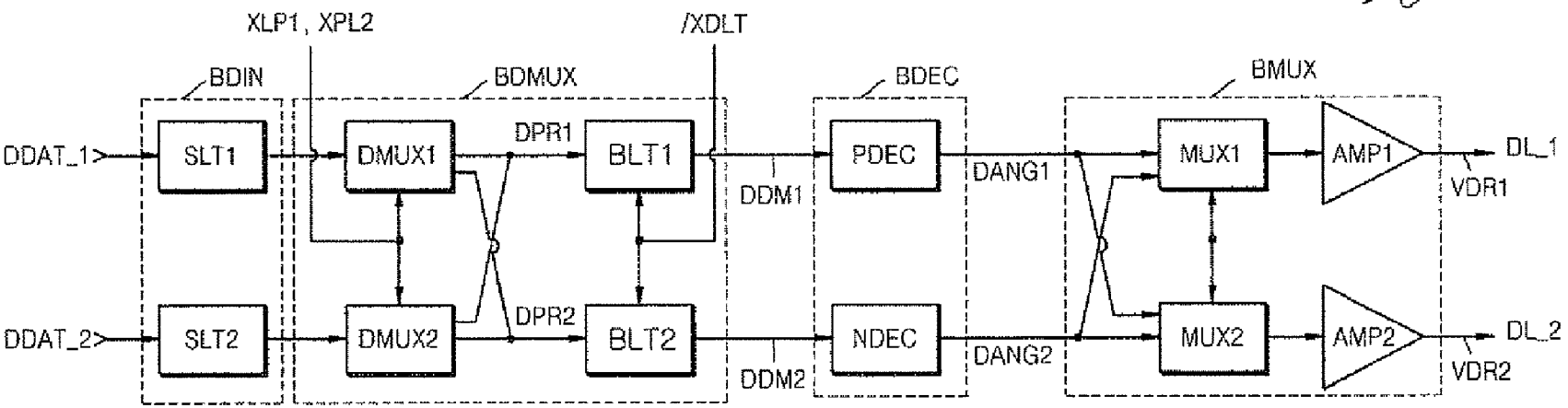
FIG. 5 is a diagram showing the line pair driving block of FIG. 4 in detail.

FIG. 5 is a diagram showing the line pair driving block LPDBK1 of FIG. 4. Referring to FIG. 5, the line pair driving block LPDBK1 comprises a data receiving portion BDIN, a de-multiplexing portion BDMUX, a decoding portion BDEC and a multiplexing portion BMUX.

The data receiving portion BDIN receives first digital data DDAT_1 and second digital data DDAT_2 from the data bus DA_BUS. The data receiving portion BDIN comprises a first sampling latch SLT_1 and a second sampling latch SLT_2. The first sampling latch SLT_1 samples and latches the first digital data DDAT_1 in the bus data DBUS with relevant timing. The second sampling latch SLT_2 samples and latches the second digital data DDAT_2 in the bus data DBUS with relevant timing.

The de-multiplexing portion BDMUX de-multiplexes the first and second digital data DDAT_1 and DDAT_2 received from the data receiving portion BDIN, and then generates first and second de-multiplexing data DDM1 and DDM2. In this embodiment, the first and second de-multiplexing data DDM1 and DDM2 are selectively corresponding to the first and second digital data DDAT_1 and DDAT_2, according to first and second loading polarity control signals XLP1 and XLP2. The first and second loading polarity control signals XLP1 and XLP2 are activated without overlapping. The first and second de-multiplexing data DDM1 and DDM2 are latched in accordance with a de-multiplexing latch signal XDLT.

The de-multiplexing portion BDMUX comprises, for example, a first de-multiplexer DMUX1, a second de-multiplexer DMUX2, a first buffer latch BLT1 and a second buffer latch BLT2. The first de-multiplexer DMUX1 de-multiplexes the first digital data DDAT_1 to generate one of first and second pre-data DPR1 and DPR2, according to the first and second loading polarity control signals XLP1 and XLP2. The second de-multiplexer DMUX2 de-multiplexes the second digital data DDAT_2 to generate the other of the first and second pre-data DPR1 and DPR2, according to the first and second loading polarity control signals XLP1 and XLP2.

In the embodiment of FIG. 5, the first and second digital data DDAT_1 and DDAT_2, which are provided to the first and second de-multiplexers DMUX1 and DMUX2, are latched in the first and second sampling latches SLT1 and SLT2, respectfully.

The first buffer latch BLT1 latches the first pre-data DPR1, and generates the latched data as the first de-multiplexing data DDM1. The second buffer latch BLT2 latches the second pre-data DPR2, and generates the latched data as the second de-multiplexing data DDM2.

Figure 6:
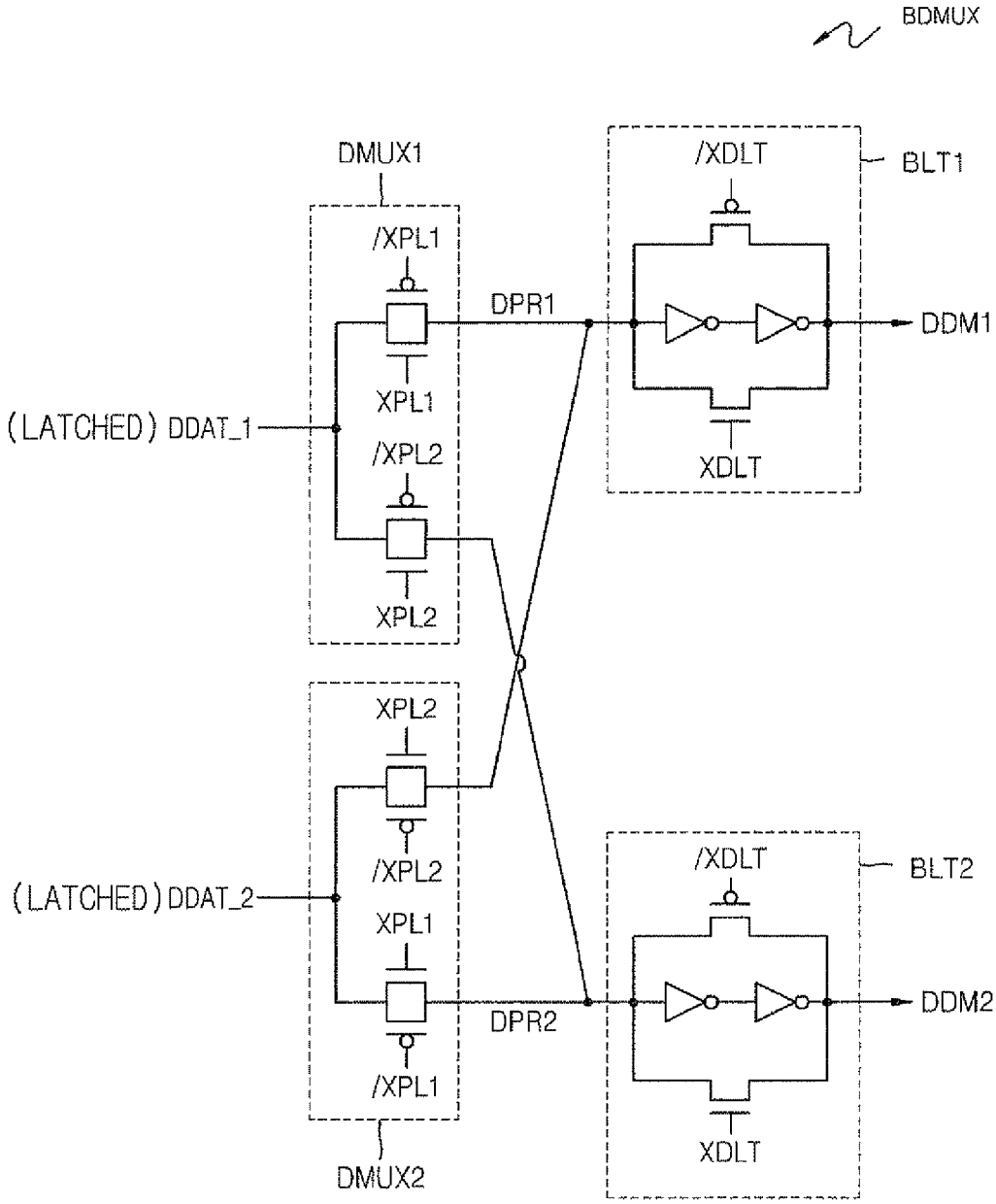
FIG. 6 is a diagram showing the de-multiplexing portion of FIG. 5 in detail.

FIG. 6 is a diagram showing the de-multiplexing portion of FIG. 5 in detail. Referring to FIG. 6, the operation of the de-multiplexing portion BDMUX will be described.

When the first loading polarity signal XLP1 is in an activated state "H", and the second loading polarity signal XLP2 is in an inactivated state "L", the first de-multiplexer DMUX1 receiving the first digital data DDAT_1 outputs the first pre-data DPR1, and the second de-multiplexer DMUX2 receiving the second digital data DDAT_2 outputs the second pre-data DPR2.

When the first loading polarity signal XLP1 is in the inactivated state "L", and the second loading polarity signal XLP2 is in the activated state "H", the first de-multiplexer DMUX1 receiving the first digital data DDAT_1 outputs the second pre-data DPR2, and the second de-multiplexer DMUX2 receiving the second digital data DDAT_2 outputs the first pre-data DPR1.

When the de-multiplexing latch signal XDLT is in the inactivated state "L", the first buffer latch BLT1 provides the first de-multiplexing data DDM1 with buffering the first pre-data DPR1. When the de-multiplexing latch signal XDLT is transited into the activated state "H", the first pre-data DPR1, which is provided as the first de-multiplexing data DDM1, is latched.

Also, when the de-multiplexing latch signal XDLT is in the inactivated state "L", the second buffer latch BLT2 provides the second de-multiplexing data DDM2 with buffering the second pre-data DPR2. When the de-multiplexing latch signal XDLT is transited into the activated state "H", the second pre-data DPR2, which is provided as the second de-multiplexing data DDM2, is latched.

Returning to FIG. 5, the decoding portion BDEC decodes the first de-multiplexing data DDM1, and generates first analog data DANG1 having a positive polarity. Also, the decoding portion BDEC decodes the second de-multiplexing data DDM2, and generates second analog data DANG2 having a negative polarity.

The decoding portion BDEC comprises, for example, a positive decoder PDEC and a negative decoder NDEC. The positive decoder PDEC decodes the first de-multiplexing data DDM1 to generate the first analog data DANG1. The negative decoder NDEC decodes the second de-multiplexing data DDM2 to generate the second analog data DANG2.

The multiplexing portion BMUX multiplexes the first and second analog data DANG1 and DANG 2 to generate the first and second gradation voltages VDR1 and VDR2. The multiplexing portion BMUX drives the first and second data lines DL__1 1 and DL_2 with the first and second gradation voltages VDR1 and VDR2. The first gradation voltage VDR1 is corresponding to the first digital data DDAT_1, and the second gradation voltage VDR2 is corresponding to the second digital data DDAT_2.

The multiplexing portion BMUX comprises, for example, a first multiplexer MUX1, a second multiplexer MUX2, a first amplifier AMP1 and a second amplifier AMP2. The first multiplexer MUX1 multiplexes the first and second analog data DANG1 and DANG2. The output of the first multiplexer MUX1 is corresponding to the first digital data DDAT_1, and the output of the second multiplexer MUX2 is corresponding to the second digital data DDAT_2.

The first amplifier AMP1 amplifies the output of the first multiplexer MUX1 to generate the first gradation voltage VDR1, and the second amplifier AMP2 amplifies the output of the second multiplexer MUX2 to generate the second gradation voltage VDR2.

Returning to FIG. 4, the source driver in this embodiment further comprises a control block BKCON. The control block BKCON receives a loading signal XLD and a polarity signal XPOL to generate the first and second loading polarity control signals XLP1 and XLP2 and the de-multiplexing latch signal XDLT.

The loading signal XLD and the polarity signal XPOL are provided from a controller. The loading signal XLD has the information of loading timing for the first and second digital data DDAT_1 and DDAT_2. The polarity signal XPOL has the information of polarity for the first and second gradation voltage VDR1 and VDR2.

As a result, the first and second loading polarity control signals XLP1 and XLP2, and the de-multiplexing latch signal XDLT, which are generated from the control block BKCON, have both the information of the loading timing for the first and second digital data DDAT_1 and DDAT_2 and the information of the polarity for the first and second gradation voltages VDR1 and VDR2.

Figure 7:
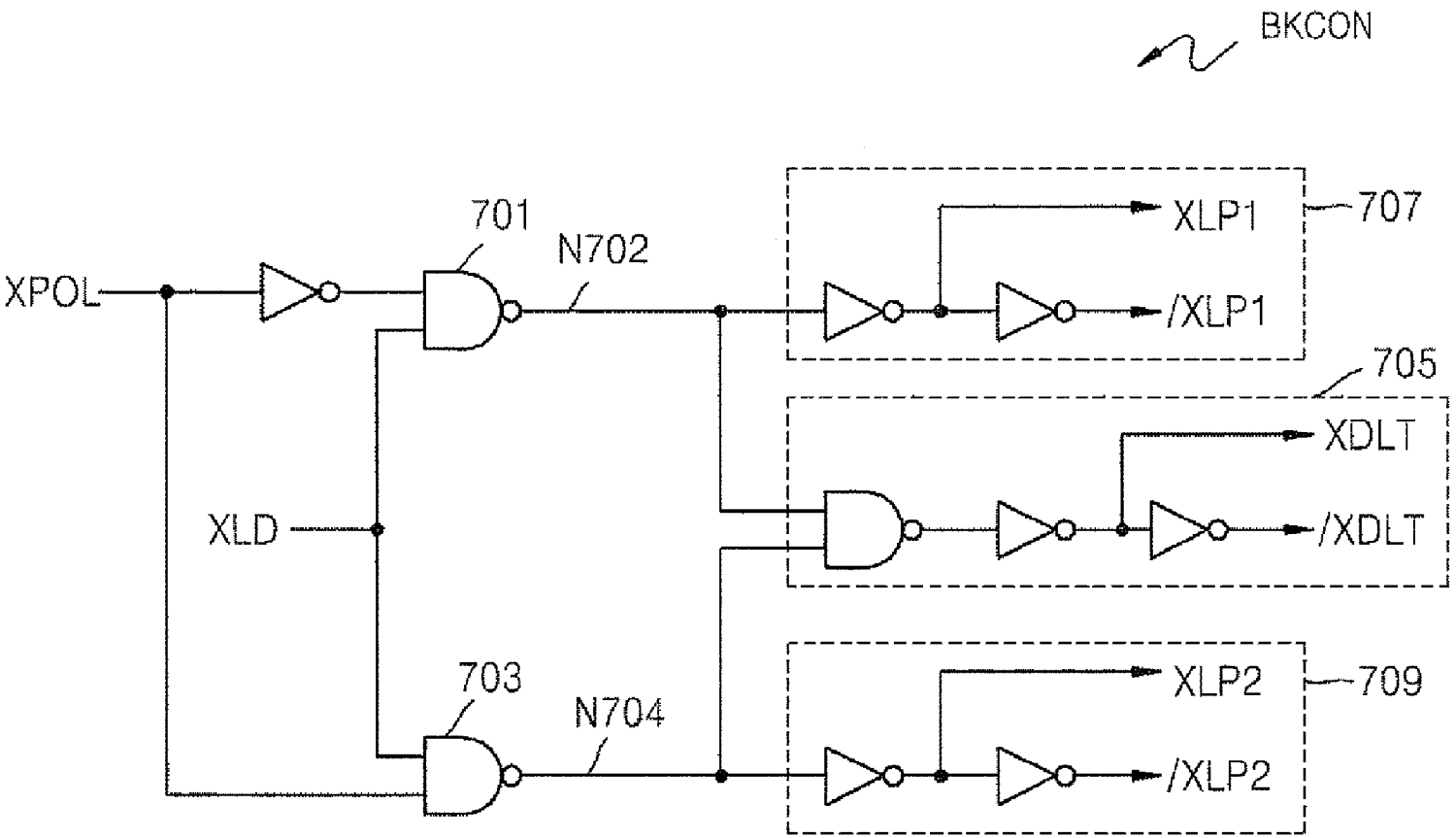
FIG. 7 is a diagram showing the control block of FIG. 4 in detail.

FIG. 7 is a diagram showing the control block BKCON of FIG. 4 in detail. Referring to FIG. 7, the control block BKCON comprises, for example, a first logic 701, a second logic 703, a third logic 705, a first buffer 707 and a second buffer 709.

The first logic 701 operates logically the loading signal XLD and the inverted signal of the polarity signal XPOL. In this embodiment, the first logic 701 multiplies logically the loading signal XLD and the inverted signal of the polarity signal XPOL, and inverts the result of the operation.

The second logic 703 operates logically the loading signal XLD and the polarity signal XPOL. In this embodiment, the second logic 703 multiplies logically the loading signal XLD and the polarity signal XPOL, and inverts the result of the operation.

The third logic 705 operates logically the output N702 of the first logic 701 and the output N704 of the first logic 703. In this embodiment, the third logic 705 multiplies logically the output N702 of the first logic 701 and the output N704 of the second logic 703 to generate the de-multiplexing latch signal XDLT.

The first buffer 707 buffers the output N702 of the first logic 701 to generate the first loading polarity control signal XLP1. The second buffer 709 buffers the output N704 of the second logic 703 to generate the second loading polarity control signal XLP2.

Figure 8:
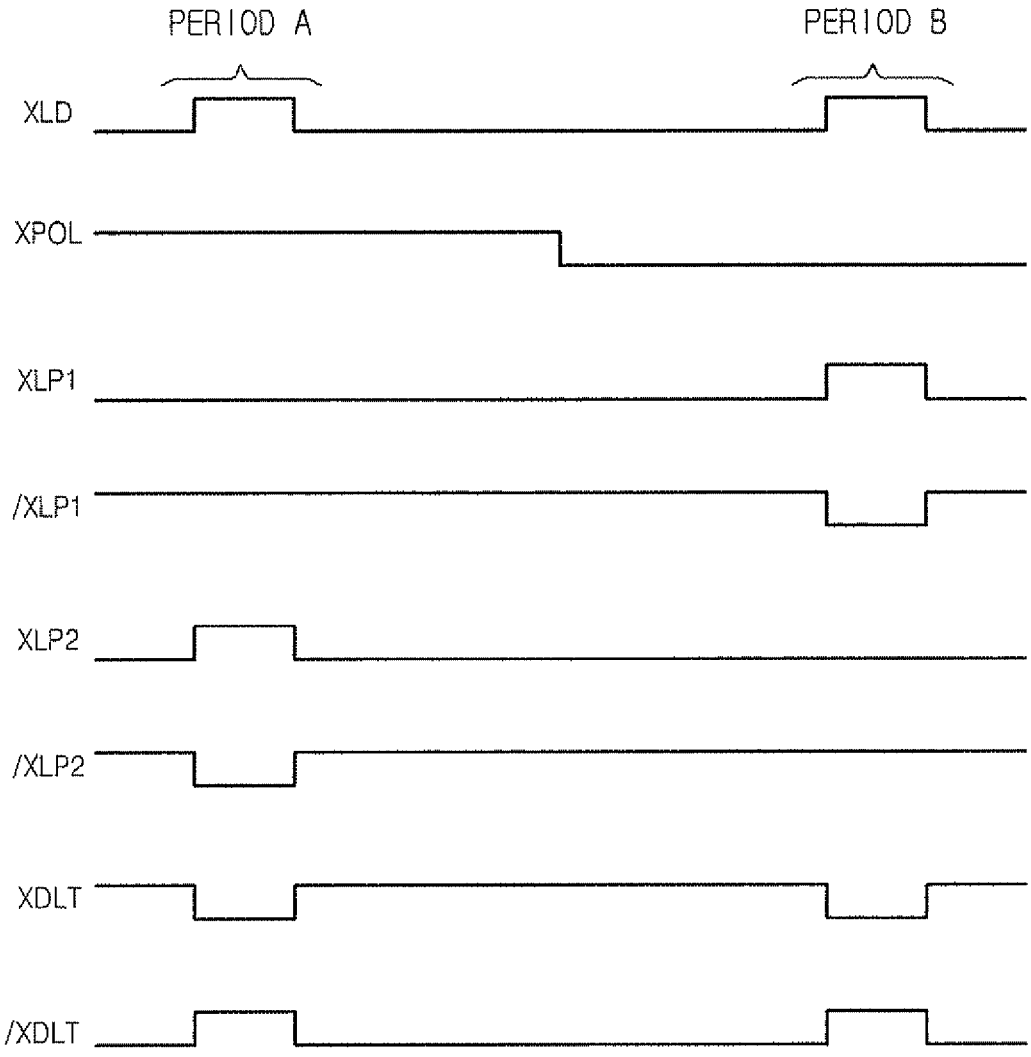
FIG. 8 is a timing diagram for explaining the operation of the signals in the control block of FIG. 7.

FIG. 8 is a timing diagram for explaining the operation of the signals in the control block BKCON of FIG. 7. Referring to FIG. 8, in the period A where the polarity signal XPOL is in the activated state "H", when the loading signal XLD is activated to the state "H", the second loading polarity control signal XLP2 is activated to the state "H", while the first loading polarity control signal XLP1 is maintained in the inactivated state "L".

In the period B where the polarity signal XPOL is in the inactivated state "L", when the loading signal XLD is activated to the state "H", the first loading polarity control signal XLP1 is activated to the state "H", while the second loading polarity control signal XLP2 is maintained in the inactivated state "L".

In both the period A and the period B, the de-multiplexing latch signal XDLT is inactivated to the state "L".

As results, in the period A, the first digital data DDAT_1 is converted to the first gradation voltage VDR1 having the negative polarity by the negative decoder NDEC which is disposed at the side of the second data line DL_2. The first gradation voltage VDR1 is provided to drive the first data line DL1.

Also, in the period A, the second data DDAT_2 is converted to the second gradation voltage VDR2 having the positive polarity by the positive decoder PDEC which is disposed at the side of the first data line DL_1. The second gradation voltage VDR2 is provided to drive the second data line DL_2.

In the period B, the first digital data DDAT_1 is converted to the first gradation voltage VDR1 having the positive polarity by the positive decoder PDEC which is disposed at the side of the first data line DL_1. The first gradation voltage VDR1 is provided to drive the first data line DL_1.

Also, in the period B, the second data DDAT_2 is converted to the second gradation voltage VDR2 having the negative polarity by the negative decoder NDEC which is disposed at the side of the second data line DL_2. The second gradation voltage VDR2 is provided to drive the second data line DL_2.

Accordingly, the first data line DL_1 is driven with the first gradation voltage VDR1 alternatively changing its polarity between the positive polarity and the negative polarity. The second data line DL_2 is driven with the second gradation voltage VDR2 alternatively changing its polarity between the positive polarity and the negative polarity. Therefore, each of the pixels in the display panel is driven by the data inversion driving method.

In the source driver of the present invention, the first and second loading polarity control signals XLP1 and XLP2, and the de-multiplexing latch signal XDLT have both the information of the loading timing for the first and second digital data DDAT_1 and DDAT_2 and the information of the polarity for the first and the second gradation voltages VDR1 and VDR2.

The de-multiplexing portion BDMUX in each of the line pair driving blocks LPDBKs is controlled by the combination of the first and second loading polarity control signals XLP1 and XLP2 and the de-multiplexing latch signal XDLT.

In other words, the de-multiplexing portion BDMUX is controlled by the signals having both the information of the loading timing and the information of the polarity. Therefore, the number of the elements in the source driver can be reduced, and thus the layout area can be remarkably decreased.

A description of another embodiments of the present invention follows to show the advantages of the best embodiments of the present invention which have been described above.

Figure 9:
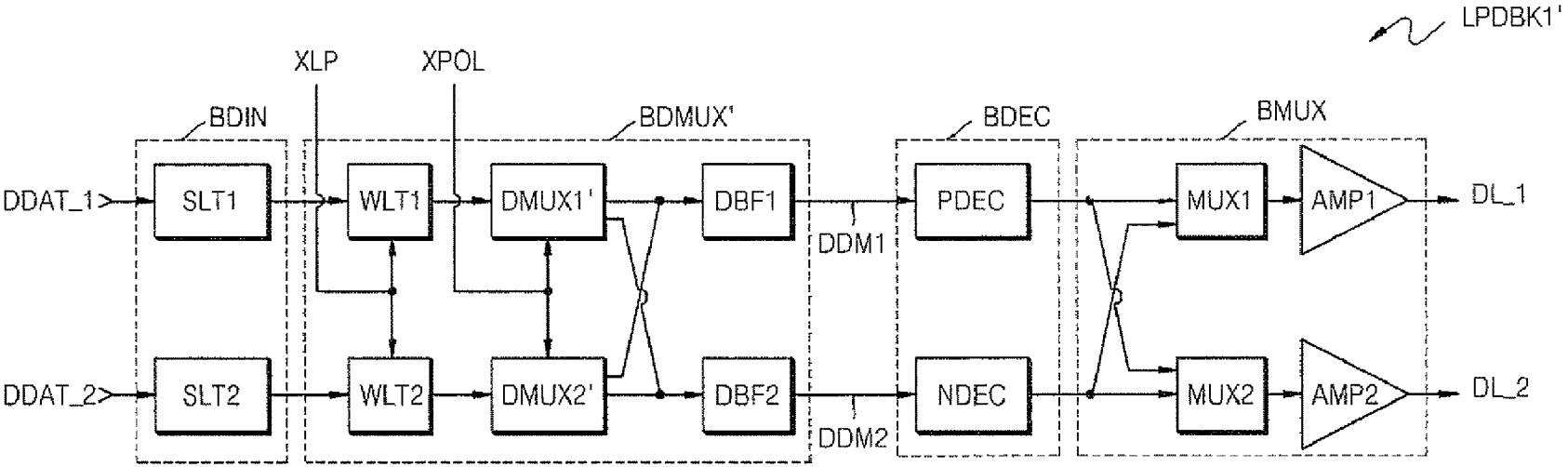
FIG. 9 is a block diagram showing another exemplary embodiment of the line pair driving block of FIG. 4.

FIG. 9 is a block diagram showing another exemplary embodiment of the line pair driving block according to the present invention.

In FIG. 9, the same references are used for the same parts of the line pair driving block in FIG. 5. And, the apostrophe (') is added to the same references for the elements to be compared with those of FIG. 5.

The line pair driving block LPDBK1' of FIG. 9 comprises a data receiving portion BDIN, a de-multiplexing portion BDMUX', a decoding portion BDEC and a multiplexing portion BMUX. The construction and the operation of the data receiving portion BDIN, the decoding portion BDEC and the multiplexing portion BMUX in FIG. 9 are substantially same as those of the data receiving portion BDIN, the decoding portion BDEC and the multiplexing portion BMUX in FIG. 5, and thus repeated description thereof is omitted.

The de-multiplexing portion BDMUX' of FIG. 9 comprises, for example, a first switching latch WLT1, a second switching latch WLT2, a first de-multiplexer DMUX1', a second de-multiplexer DMUX2', a first de-multiplexing buffer DBF1 and a second de-multiplexing buffer DBF2.

The first switching latch WLT1 loads and latches the first digital data DDAT_1 in accordance with the loading signal XLD. The second switching latch WLT2 loads and latches the second digital data DDAT_2 in accordance with the loading signal XLD.

The first de-multiplexer DMUX1' de-multiplexes the first digital data DDAT_1 latched by the first switching latch WLT1 according to the polarity signal XPOL. The output of the first de-multiplexer DMUX1' is provided to one of the first and second de-multiplexing buffers DBF1 and DBF2.

Also, the second de-multiplexer DMUX2' de-multiplexes the second digital data DDAT_2 latched by the second switching latch WLT2 according to the polarity signal XPOL. The output of the second de-multiplexer DMUX2' is provided to the other of the first and second de-multiplexing buffers DBF1 and DBF2.

The first de-multiplexing buffer DBF1 buffers the output of the first de-multiplexer DMUX1', and generates the first de-multiplexing data DDM1. The second de-multiplexing buffer DBF2 buffers the output of the second de-multiplexer DMUX2', and generates the second de-multiplexing data DDM2.

Figure 10:
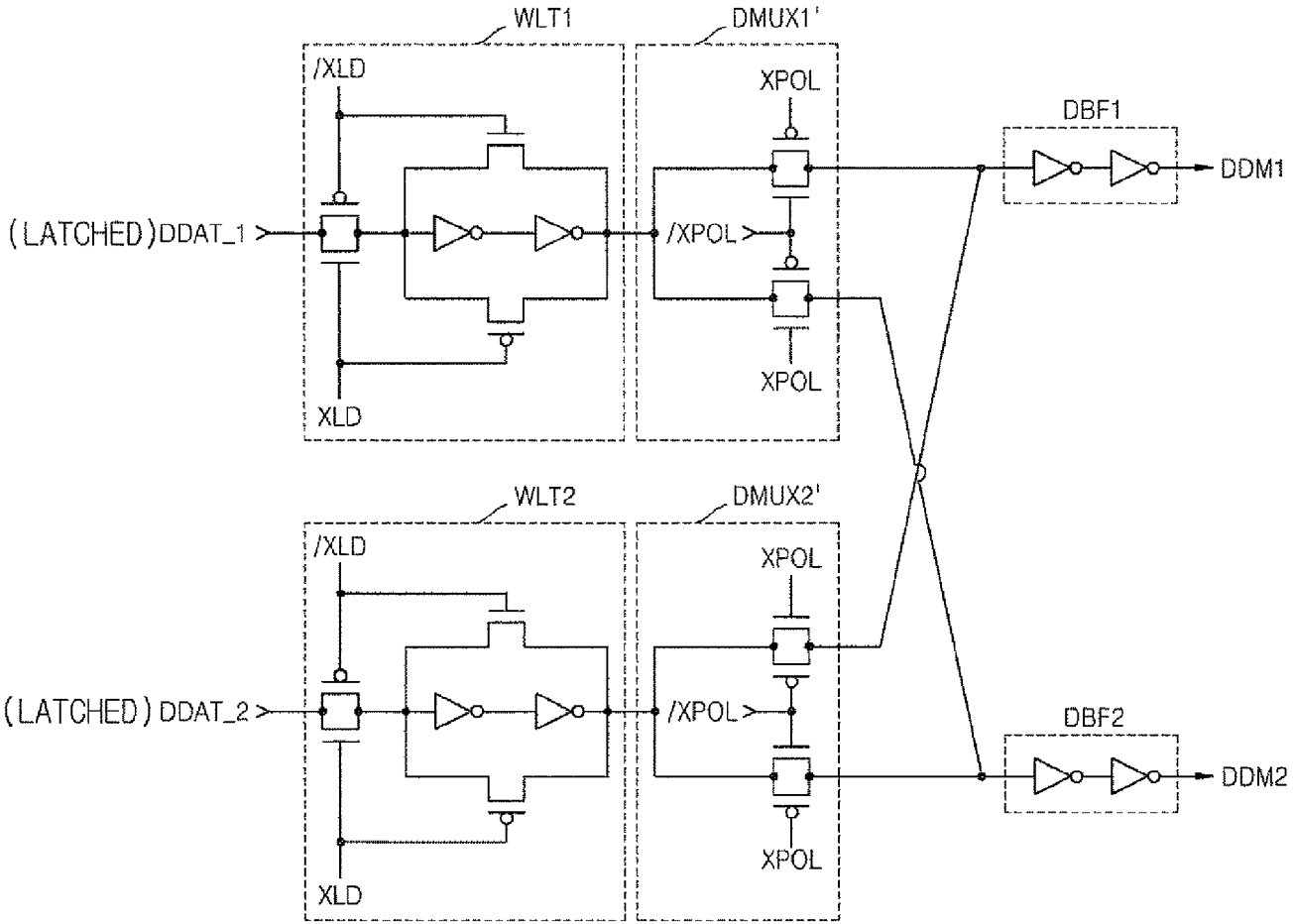
FIG. 10 is a diagram showing the de-multiplexing portion of FIG. 9 in detail.

FIG. 10 is a diagram showing an exemplary embodiment of the de-multiplexing portion BMUX' of FIG. 9 in detail. As shown in FIG. 10, the de-multiplexing portion BMUX' of this embodiment includes sixteen transistors and eight invertors. In other words, the de-multiplexing portion BMUX' of FIG. 10 requires at least thirty two transistors for its implementation.

In contrast, the de-multiplexing portion BMUX of FIG. 6 is constructed with twelve transistors and four invertors. In other words, the de-multiplexing portion BMUX of FIG. 6 employs twenty transistors for its implementation.

Thus, the layout area required for the source driver having the de-multiplexing portion BDMUX of FIG. 6 is smaller than that for the source driver having the de-multiplexing portion BDMUX' of FIG. 10.

Although the exemplary embodiments of the present invention have been disclosed for illustrative purposes, those skilled in the art may appreciate that various modifications, additions and substitutions are possible, without departing from the scope and spirit of the invention as disclosed in the accompanying claims.

Therefore, the technical scope of the present invention should be defined by the technical spirit of the accompanying claims.

What is claimed is:

1. A source driver for display devices, comprising;

line pair driving blocks that are each operated to drive a first data line and a second data line being adjacent to each other in a display panel; and a control block for receiving a loading signal and a polarity signal to generate first and second loading polarity control signals and a de-multiplexing latch signal, wherein the loading signal has information of loading timing for first and second digital data, and the polarity signal has information of polarity for first and second gradation voltages, wherein each of the line pair driving blocks comprises:

a data receiving portion for receiving the first and second digital data in the first and second data lines;

a de-multiplexing portion for de-multiplexing the first and second digital data to generate first and second de-multiplexing data, wherein the first and second de-multiplexing data are selectively corresponding to the first and second digital data according to the first and second loading polarity control signals, and the first and second de-multiplexing data are latched in accordance with the de-multiplexing latch signal;

a decoding portion for decoding the first and second de-multiplexing data to generate first and second analog data, wherein the first and second analog data have first and second polarities, respectively; and a multiplexing portion for multiplexing the first and second analog data to generate the first and second gradation voltages, wherein the first and second gradation voltages are corresponding to the first and second digital data, respectively.

2. The source driver according to claim 1, wherein the data receiving portion comprises:

a first sampling latch for sampling and latching the first digital data in the first data line; and a second sampling latch for sampling and latching the second digital data in the second date line.

3. The source driver according to claim 1, wherein the de-multiplexing portion comprises:

a first de-multiplexer for de-multiplexing the first digital data to generate one of first and second pre-data according the first and second loading polarity control signals;

a second de-multiplexer for de-multiplexing the second digital data to generate the other of the first and second pre-data according the first and second loading polarity control signals;

a first buffer latch for latching the first pre-data to generate the first de-multiplexing data; and a second buffer latch for latching the second pre-data to generate the second de-multiplexing data.

4. The source driver according to claim 1, wherein the decoding portion comprises:

a positive decoder for decoding the first de-multiplexing data to generate the first analog data; and a negative decoder for decoding the second de-multiplexing data to generate the second analog data.

5. The source driver according to claim 1, wherein the multiplexing portion comprises:

a first multiplexer for multiplexing the first and second analog data to generate an output corresponding to the first digital data;

a second multiplexer for multiplexing the first and second analog data to generate an output corresponding to the second digital data;

a first amplifier for amplifying an output of the first multiplexer to generate the first gradation voltage; and a second amplifier for amplifying an output of the second multiplexer to generate the second gradation voltage.

6. The source driver according to claim 1, wherein the control block comprises:

a first logic for logically operating the loading signal and an inverted signal of the polarity signal;

a second logic for logically operating the loading signal and the polarity signal;

a third logic for logically operating an inverted signal of an output of the first logic and an inverted signal of an output of the second logic to generate the de-multiplexing latch signal;

a first buffer for buffering the output of the first logic to generate the first loading polarity control signal; and a second buffer for buffering the output of the second logic to generate the second loading polarity control signal.

7. The source driver according to claim 1, wherein the first and second loading polarity control signals have both the information of the loading timing for the first and second digital data and the information of the polarity for the first and second gradation voltages.

8. The source driver according to claim 1, wherein the de-multiplexing latch signal has both the information of the loading timing for the first and second digital data and the information of the polarity for the first and second gradation voltages.

* * * * *